US006705390B2

(12) United States Patent
Ohara

(10) Patent No.: US 6,705,390 B2
(45) Date of Patent: Mar. 16, 2004

(54) COOLING APPARATUS BOILING AND CONDENSING REFRIGERANT WITH A REFRIGERANT VAPOR PASSAGE HAVING A LARGER CROSS SECTIONAL AREA

(75) Inventor: Takahide Ohara, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/279,164

(22) Filed: Oct. 24, 2002

(65) Prior Publication Data

US 2003/0079864 A1 May 1, 2003

(30) Foreign Application Priority Data

Oct. 25, 2001 (JP) ..... 2001-327444

(51) Int. Cl.[7] ..... F28D 15/00

(52) U.S. Cl. ..... 165/104.21; 165/104.33; 361/700; 257/715; 174/15.2

(58) Field of Search ..... 165/104.21, 104.26, 165/104.33, 80.4, 80.3; 361/700, 699; 257/714, 715; 174/15.2, 16.3

(56) References Cited

U.S. PATENT DOCUMENTS 4,561,040 A * 12/1985 Eastman et al. ..... 165/80.4
5,427,174 A * 6/1995 Lomolino, Sr. et al. ..... 165/104.26
5,998,863 A * 12/1999 Kobayashi et al. .... 165/104.33
6,005,772 A * 12/1999 Terao et al. ..... 165/104.33
6,014,312 A * 1/2000 Schulz-Harder et al. ... 165/80.4

FOREIGN PATENT DOCUMENTS

JP 10-74874 3/1998

* cited by examiner

*Primary Examiner*—Christopher Atkinson
(74) *Attorney, Agent, or Firm*—Harness, Dickey & Pierce, PLC

(57) ABSTRACT

Tubes 3 are provided substantially upright on an upper surface of a refrigerant container 2 by inserting lower end portions thereof into inserting holes 5 of the refrigerant container 2. The tube 3A, differed from the tubes 3B, has a trumpet shape which is suddenly increased in its passage cross section towards the lower end opening portion. Thus, most of refrigerant vapor boiled and evaporated in the refrigerant container 2 can be collectively introduced into the tube 3A located within the boiling area. The refrigerant vapor entered a header tank 4 from the tube 3A is diffused in the header tank 4, and is introduced into the tubes 3B located out of the boiling area. The condensate produced by cooling the refrigerant vapor upon passing through the tubes 3B can be circulated into the refrigerant container 2.

2 Claims, 7 Drawing Sheets

COOLING APPARATUS BOILING AND CONDENSING REFRIGERANT WITH A REFRIGERANT VAPOR PASSAGE HAVING A LARGER CROSS SECTIONAL AREA

BACKGROUND OF THE INVENTION

1. Field of the Invention

This invention relates to a cooling apparatus boiling and condensing refrigerant which cools a heat-generating member by heat transfer with boiling of a refrigerant.

2. Description of the Related Art

A conventional cooling apparatus boiling and condensing refrigerant is indicated in FIG. 7, by way of example.

This cooling apparatus boiling and condensing refrigerant is comprised of a refrigerant container 100 which reserves refrigerant liquid, a pair of headers 110, 120 each of which is connected to the refrigerant container 100, a plurality of tubes 130 provided between the header 110 and the header 120, and heat radiating fins 140 for radiating heat transferred from the tubes 130 into the air. A heat-generating element 150 is attached to a bottom surface of the refrigerant container 100.

A separating wall 160 which determines a direction of circulation of the refrigerant is provided in the refrigerant container 100. Accordingly, as indicated by arrows in the drawing, the refrigerant, in the refrigerant container 100, boiled by receiving heat from the heat-generating element 150 is introduced, from the refrigerant container 100 to the header 110, from the header 110 to the other header 120, being cooled upon passing through each tube 130, and is circulated into the refrigerant container 100 from the header 120, as a condensed refrigerant.

The above cooling apparatus boiling and condensing refrigerant generates refrigerant vapor mostly at a portion to which the heat-generating element 150 is attached, however, the refrigerant vapor can be generated at other portions. Accordingly, in the refrigerant container 100 on which the heat-generating element 150 is mounted, the heat is transferred, in progression, from the portion to which the heat-generating element 150 is attached. The temperature of the refrigerant container 100 is increased at a portion which is near the circulating portion to which the header 120 is connected. Accordingly, the refrigerant vapor is also generated near the circulating portion of the refrigerant container 100. Therefore, when the refrigerant vapor enters the header 120, it can oppose the condensed refrigerant which is circulated from the header 120 into the refrigerant container 100. Due to this, a malfunction of refrigerant circulation is caused and the efficiency of the apparatus is degraded.

SUMMARY OF THE INVENTION

In view of the drawbacks mentioned above, according to the invention, there is provided a cooling apparatus boiling and condensing refrigerant in which a malfunction of refrigerant circulation, caused by opposed flows between condensed refrigerant and refrigerant vapor, can be prevented and the degradation of the efficiency thereof can be eliminated. The other purpose of the invention is to provide the cooling apparatus boiling and condensing refrigerant in which the circulation of the refrigerant can be performed smoothly without increasing the size thereof and can be more easily assembled.

The first Aspect of the Invention

According to the invention, there is provided a cooling apparatus boiling and condensing refrigerant in which refrigerant reserved in a refrigerant container can be boiled and evaporated by receiving heat from a heat-generating member and can be used to cool the heat-generating member by radiating latent heat of refrigerant vapor from a heat radiating portion; and when it is assumed that a portion of the upper surface of the refrigerant container on which a mounting portion of the heat-generating member is projected is referred to a boiling area, the tube located within the boiling area has a passage defined by a lower end opening portion connected to the refrigerant container and has a passage cross sectional area larger than that of the tubes located outside the boiling area.

According to the constitution, the refrigerant vapor evaporated by receiving the heat from the heat-generating member can be introduced, with the high priority, in the tube located within the boiling area. Thus, the refrigerant vapor is introduced into a header tank through the tube located within the boiling area, and the refrigerant vapor diffused in the header tank is circulated into the refrigerant container in the form of a condensate after being cooled while passing the tubes located out of the boiling area.

In the present invention, the circulation of the refrigerant can be improved by making the size of a passage cross section of the lower end opening portion of the tube located within the boiling area larger than other tubes. Therefore, neither the size of the heat radiating portion nor the overall size of the apparatus are increased.

The length of the tube located within the boiling area can be identical to that of the tube located out of the boiling area. Both end portions of each tube can be secured in the vertical direction. Thus, the apparatus of the invention can be more easily assembled and can be mass-produced at a lower cost than the cooling apparatus boiling and condensing refrigerant described in the prior art.

The Second Aspect of the Invention

In the cooling apparatus boiling and condensing refrigerant according to the first aspect of the invention, the tube located within the boiling area has a shape in which the lower end portion thereof is suddenly increased in its passage cross section towards the lower end opening portion. Thus, the refrigerant vapor can be effectively introduced to the tube located in the boiling area.

The Third Aspect of the Invention

In the cooling apparatus boiling and condensing refrigerant according to the first aspect of the invention, the tube located within the boiling area has a passage cross section larger than that of the tube located outside the boiling area, over the entirely of the length from the lower end opening portion to be connected to the refrigerant container, to an upper end opening portion to be connected to the header tank.

The Fourth Aspect of the Invention

According to the invention, there is provided a cooling apparatus boiling and condensing refrigerant in which refrigerant reserved in a refrigerant container can be boiled and evaporated by receiving heat from a heat-generating member and can be used to cool the heat-generating member by radiating latent heat of refrigerant vapor from a heat radiating portion; and when it is assumed that a portion of the upper surface of the refrigerant container on which a mounting portion of the heat-generating member is projected is referred to a boiling area, the plurality of tubes are comprised of a first tube group located within the boiling area and a second tube group located out of the boiling area and the adjacent tubes of the first tube group are spaced at a distance smaller than a distance of adjacent tubes of the second tube group.

According to the constitution, the refrigerant vapor evaporated by receiving the heat from the heat-generating member can be introduced, with the high priority, in the tube located within the boiling area, and the adjacent tubes of the first tube group are spaced at a distance smaller than a distance of adjacent tubes of the second tube group. Thus, the refrigerant vapor can be collectively introduced into the tubes of the first tube group.

In the present invention, the circulation of the refrigerant can be improved by merely making the distance between adjacent tubes of the first tube group located within the boiling area smaller than that of the second tube group located out of the boiling area. Therefore, neither the size of the heat radiating portion nor the overall size of the apparatus are increased.

The length of the tubes located within the boiling area can be identical to that of the tube located out of the boiling area. Both end portions of the tube can be secured in the vertical direction. Thus, the apparatus of the invention can be more easily assembled and can be mass-produced at a lower cost than the cooling apparatus boiling and condensing refrigerant described in the prior art.

The Fifth Aspect of the Invention

In the cooling apparatus boiling and condensing refrigerant according to any one of the aspects 1 through 4, the refrigerant container is comprised of a plurality of intermediate plates having opening portions extending through the thickness thereof, a heat receiving plate which is provided on its surface with the heat-generating member, and a heat radiating plate which is provided on its surface with the tubes; the plural intermediate plates are multilayered between the heat receiving plate and the heat radiating plate; the opening portions of the intermediate plate adjacent to the heat radiating plate are made large corresponding to the boiling area projected on the heat radiating plate.

According to the constitution, the refrigerant vapor boiled and evaporated by receiving the heat from the heat-generating member is introduced in the tubes located within the boiling area through the opening portions of the intermediate plate adjacent to the heat radiating plate. As the opening portions of the intermediate plate can be increased according to the boiling area, the performance of the apparatus can be improved due to smooth circulation of the refrigerant and easy passage of the refrigerant vapor.

The present invention may be more fully understood from the description of the preferred embodiments of the invention set forth below, together with the accompanying drawings.

DESCRIPTION OF THE PREFERRED EMBODIMENTS

Figure 1:
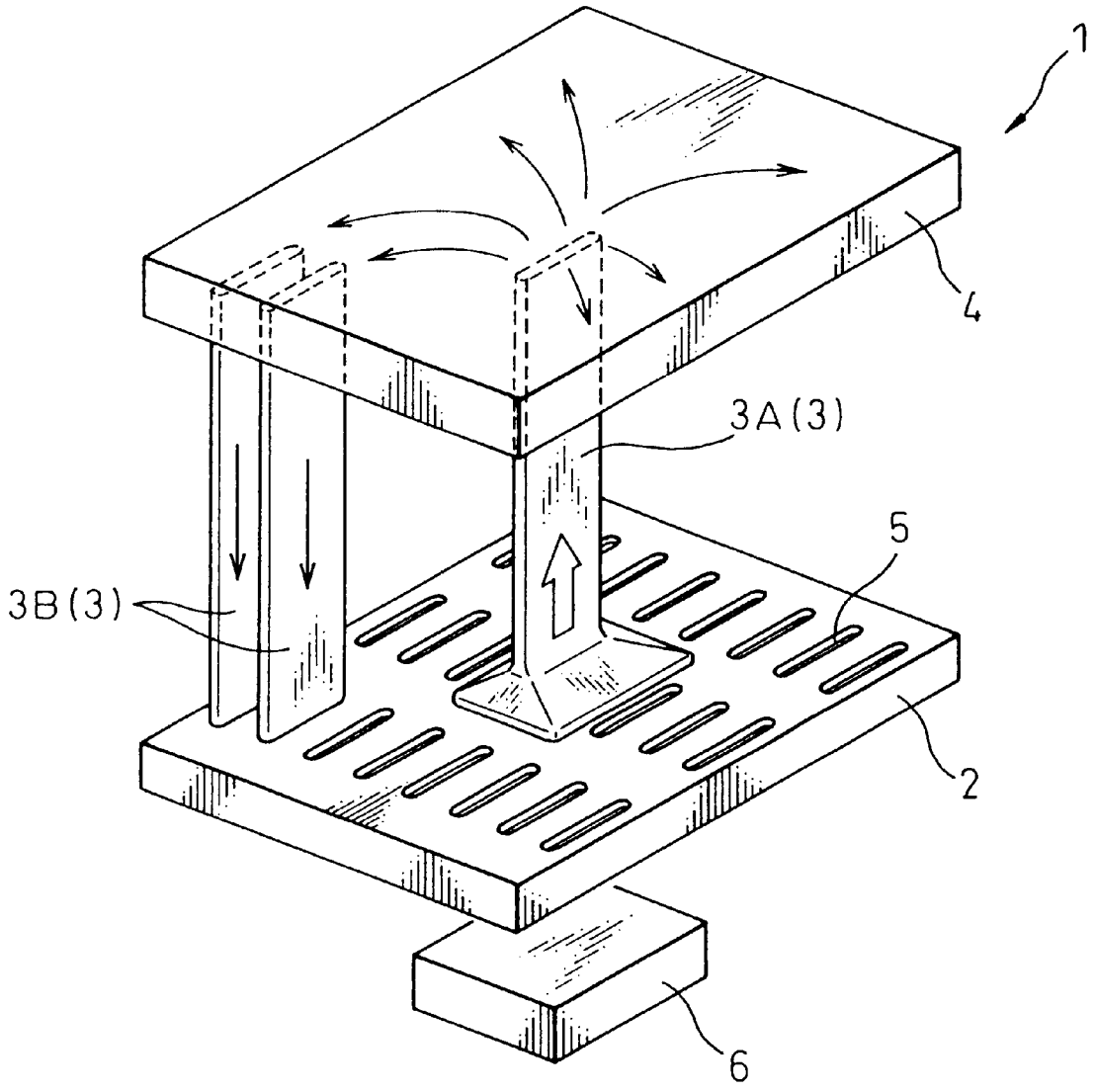
FIG. 1 is a perspective view of a cooling apparatus boiling and condensing refrigerant (the first embodiment).

Embodiments of the invention will be discussed referring to the drawings.

(The First Embodiment)

FIG. 1 is a perspective view of a cooling apparatus 1 boiling and condensing refrigerant.

The cooling apparatus 1 boiling and condensing refrigerant of the present embodiment is comprised of a refrigerant container 2 in which refrigerant is reserved, a plurality of tubes 3 (3A, 3B) which connect to the inside of the refrigerant container 2, and a header tank 4 by which a plurality of the tubes 3 are communicated; and is manufactured integrally, for example, by brazing in a vacuum.

As can be seen in FIG. 1, the refrigerant container 2 is in the form of a flat box in a vertical direction. A plurality of inserting holes 5 in which lower end portions of the tubes 3 are inserted are provided on the upper surface of the refrigerant container 2. At a center portion of a bottom surface of the refrigerant container 2, a heat-generating member 6 in which heat-generating elements such as a semiconductor device, etc. are built in is attached thereto by screws, etc. A portion of an upper surface of the refrigerant container 2 on which a mounting portion of the heat-generating member 6 is projected is followed as a boiling area.

The tubes 3 are connected to the inside of the refrigerant container 2 and are provided substantially upright on the upper surface of the refrigerant container 2 by inserting the lower end portions thereof through the inserting holes 5 of the refrigerant container 2. However, the tube 3A (provided only one tube 3A in this embodiment) located within the above-mentioned boiling area has a larger passage cross section of a lower end opening portion to be connected to the refrigerant container 2 than that of the tubes 3B located out of the boiling area. In detail, as shown in FIG. 1, the lower end portion of the tube 3A has a trumpet shape which is suddenly increased in its passage cross section towards the lower end opening portion.

An inserting hole (not shown in drawings) which opens into the boiling area of the refrigerant container 2 and corresponds to the size of the lower end opening portion of the tube 3A is larger than the other inserting holes 5. The header tank 4 is in the shape of a flat box as well as the refrigerant container 2 and connects to each tube 3 by inserting the upper end opening portion of each tube 3 therein. The heat radiating portion of the invention is comprised of the above-mentioned tubes 3 and the header tank 4. Furthermore, heat radiating fins, which are not shown in FIG. 1, may be provided in the spaces between adjacent tubes 3.

Operations of the cooling apparatus 1 boiling and condensing refrigerant will be discussed. The refrigerant reserved in the refrigerant container 2 can be evaporated into vapor by receiving the heat from the heat-generating member 6 and the refrigerant vapor is introduced into the tubes 3 from the refrigerant container 2. As the lower end opening portion of the tube 3A located within the boiling area has a larger passage cross section than the tubes 3B located out of the boiling area and the opening area of the inserting hole which opens into the boiling area of the refrigerant container 2 are larger than that of the other inserting holes 5, most of the refrigerant vapor evaporated in the refrigerant container 2 can be collectively introduced into the tube 3A located within the boiling area.

The refrigerant vapor which is introduced into the tube 3A enters the header tank 4 through the tube 3A and is diffused in the header tank 4. The refrigerant vapor in the header tank 4 is introduced into each tube 3B located out of the boiling area and is cooled by an outside air (radiating breeze) while passing through each tube 3B. The condensate of the refrigerant thus produced is circulated into the refrigerant container 2. The heat transferred from the heat-generating member to the refrigerant can be radiated outside as the latent heat upon cooling and condensing the refrigerant vapor.

(Effects of the First Embodiment)

In the cooling apparatus 1 boiling and condensing refrigerant, according to this embodiment, the refrigerant vapor boiled by receiving the heat from the heat-generating member 6 can be collectively introduced into the tube 3A by making the passage cross section of the lower end opening portion of the tube 3A located in the boiling area larger than that of the other tubes 3B. Thus, the refrigerant vapor which has entered the header tank 4 through the tube 3A and has been diffused in the header tank 4 passes inevitably in the tubes 3B provided out of the boiling area and is cooled in the tubes 3B. The condensate of the refrigerant vapor thus produced can be circulated into the refrigerant container 2. Accordingly, the circulation of the refrigerant can be performed smoothly without interference between the refrigerant vapor and the condensate.

In the cooling apparatus 1 boiling and condensing refrigerant, as the refrigerant container 2 in the shape of a flat box can be used, a sufficient heat radiating area can be obtained without increasing the size of the heat radiating portion. As all the tubes 3 (3A, 3B) can be identical in length, the overall height of the apparatus is not increased and the apparatus is less restricted upon mounting. Furthermore, as not only can the length of the tube 3A located in the boiling area be identical to that of the tubes 3B located out of the boiling area, but also the opposing end portions of each tube 3 can be mounted in the vertical direction, the apparatus, can be more easily assembled and can be mass-produced at a lower cost than the cooling apparatus boiling and condensing refrigerant described in the prior art.

(The Second Embodiment)

Figure 2:
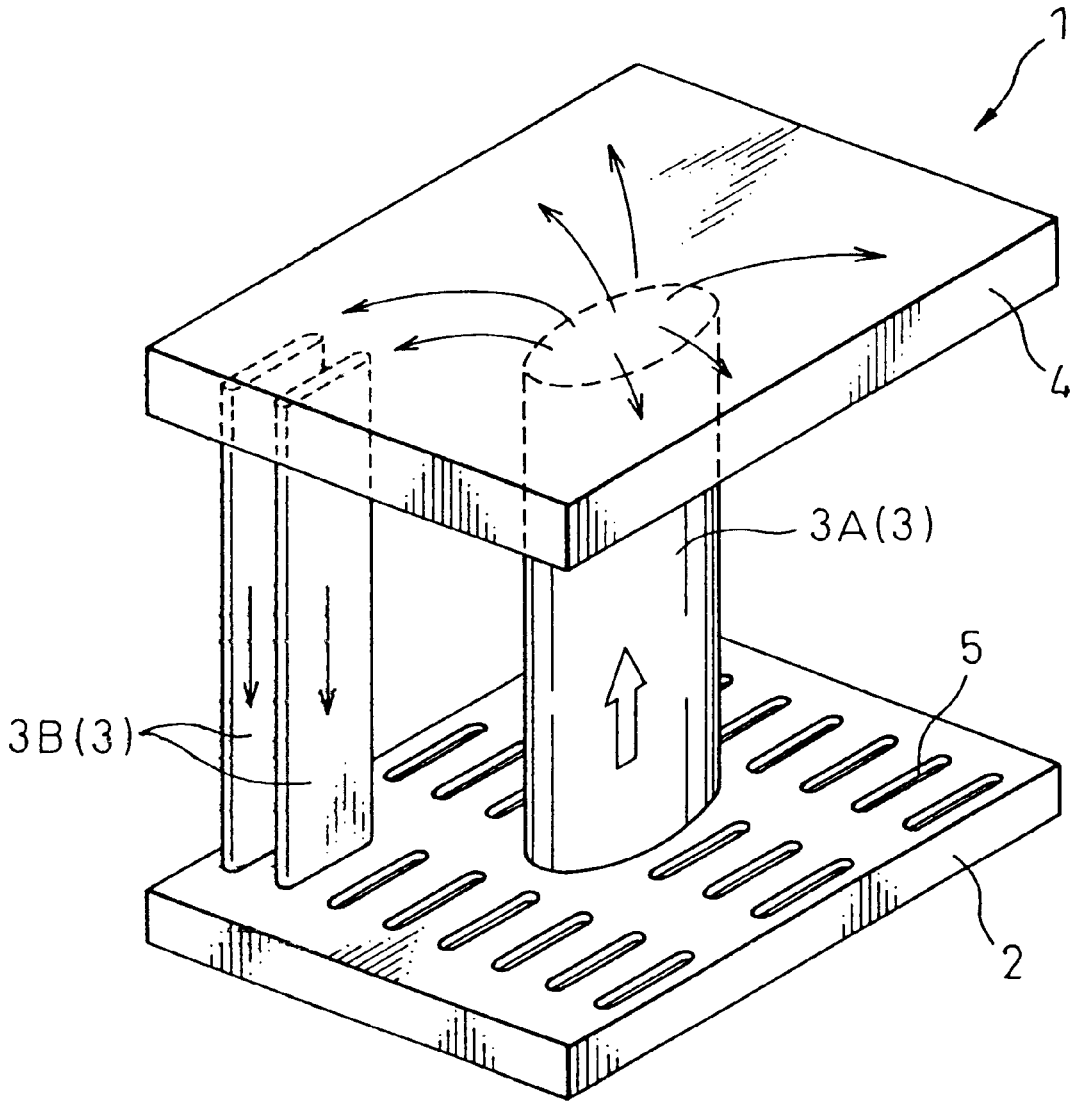
FIG. 2 is a perspective view of a cooling apparatus boiling and condensing refrigerant (the second embodiment).

FIG. 2 is a perspective view of a cooling apparatus 1 boiling and condensing refrigerant. As shown in FIG. 2, in this embodiment a tube 3A is located within the boiling area and has a larger passage cross section than other tubes 3B, over the entirely of the length thereof, by way of example. According to the constitution, as the flow resistance against the refrigerant vapor upon passing through the tube 3A can be low, the refrigerant vapor can be easily introduced into the tube 3A. Thus, the performance of the apparatus can be high by smooth circulation of the refrigerant.

(The Third Embodiment)

Figure 3:
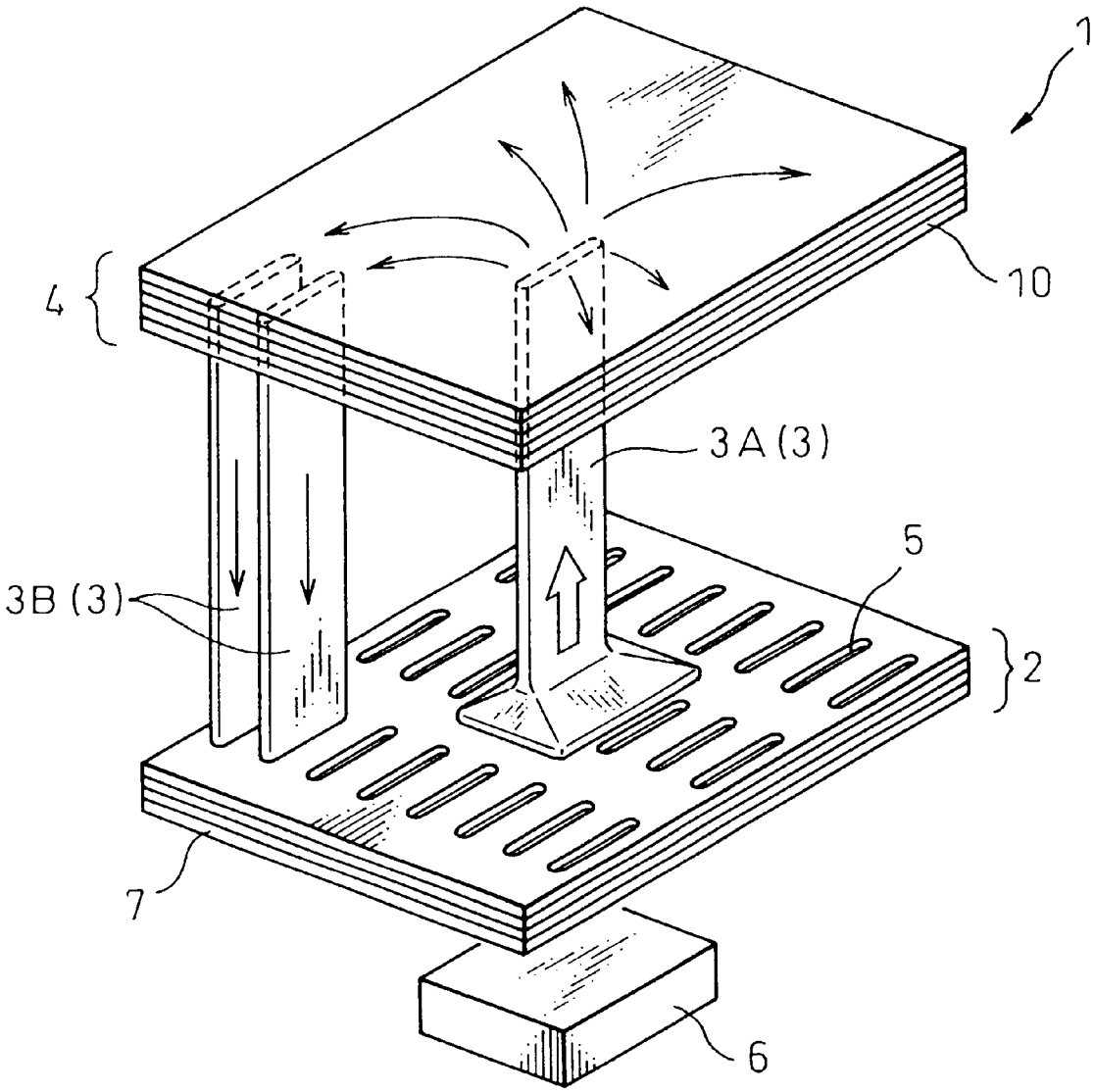
FIG. 3 is a perspective view of a cooling apparatus boiling and condensing refrigerant (the third embodiment).

FIG. 3 is a perspective view of a cooling apparatus 1 boiling and condensing refrigerant. As shown in FIG. 3, in this embodiment a multilayered refrigerant container 2 and a multilayered header tank 4 are provided, by way of example. The refrigerant container 2 is formed, for example, by superimposing four plates 7 (7A–7D), as shown in FIGS. 4A through 4D. Each of the plates 7 is obtained by punching a plate such as an aluminum plate, a stainless plate or the like using a press die. The plates 7 are comprised of a heat receiving plate 7A having a heat-generating member 6 secured to the surface thereof, a heat radiating plate 7B having tubes 3 mounted to the surface thereof, and two (or more than two) intermediate plates 7C, 7D held between the plates 7A and 7B.

Figure 4A:
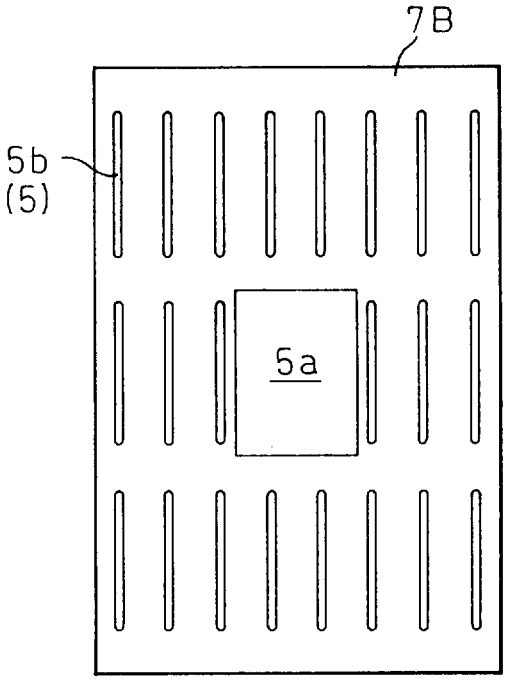
FIG. 4A is a plan view of a plate which constitutes a refrigerant container (the third embodiment).
Figure 4B:
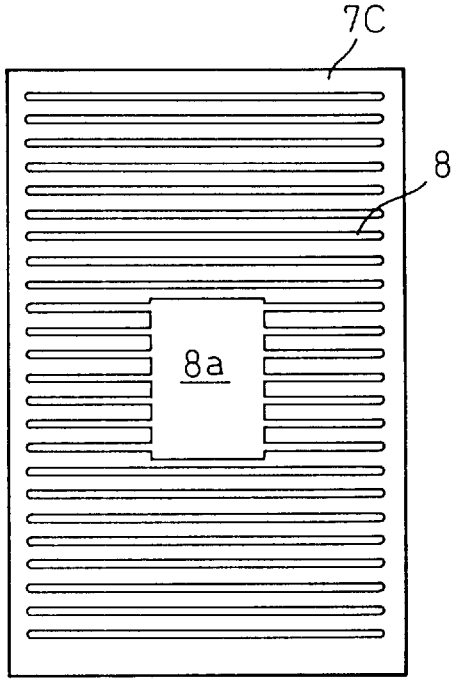
FIG. 4B is a plan view of a plate which constitutes a refrigerant container (the third embodiment).

As shown in FIG. 4A, a plurality of inserting holes 5 for inserting the end portions of the tubes 3 are formed in the heat radiating plate 7B. Note that the inserting hole 5*a* which opens into the boiling area of the refrigerant container 2 is rectangular and is larger than the other inserting holes 5*b*, corresponding to the size of the lower end opening portion of the tube 3A. As shown in FIG. 4B, a plurality of slit-shaped opening portions 8 extending in the lateral direction of the plate 7C are formed side by side at a constant pitch, in the intermediate plate 7C adjacent to the heat radiating plate 7B. A rectangular opening portion 8a which is made large corresponding to the size of the inserting hole 5*a* opening in the boiling area of the heat radiating plate 7B is formed substantially at the center portion of the intermediate plate 7C.

Figure 4C:
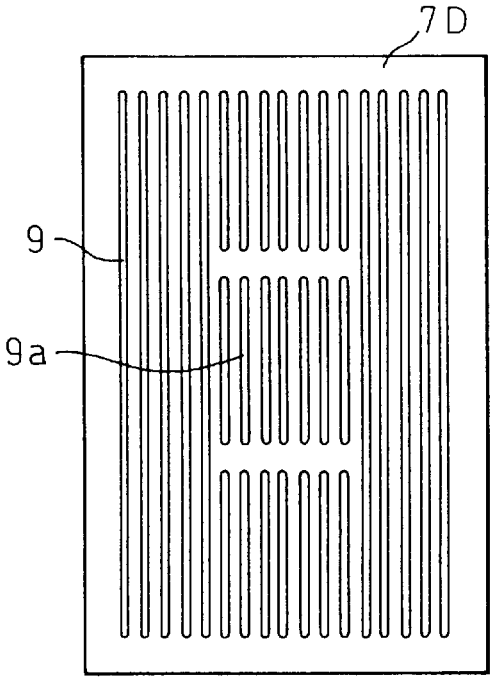
FIG. 4C is a plan view of a plate which constitutes a refrigerant container (the third embodiment).
Figure 4D:
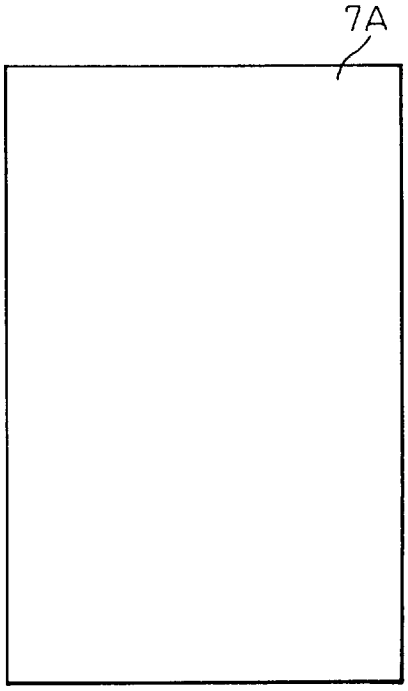
FIG. 4D is a plan view of a plate which constitutes a refrigerant container (the third embodiment).

As shown in FIG. 4C, the intermediate plate 7D adjacent to the heat receiving plate 7A has a plurality of slit-shaped opening portions 9 extending along the longitudinal direction of the intermediate plate 7D and provided side by side at a constant pitch. In a substantially central portion of the intermediate plate 7D, an opening portion 9*a*, whose vertical length is limited within the length corresponding to the portion to which the heat-generating member 6 is attached, is provided, so that the refrigerant vapor boiled by receiving the heat from the heat-generating member 6 is not diffused. As shown in FIG. 4D, the heat receiving plate 7A is a planar member having a plane for covering the whole of the opening portion 9 (including 9*a*) of the intermediate plate 7D.

The header tank 4 is a multilayered structure obtained by superimposing a plurality of plates 10 as well as the refrigerant container 2.

In the tubes 3, as well as the first embodiment, only the tube 3A located within the boiling area has a lower end opening portion which is connected to the refrigerant container 2 and the passage cross section of which is suddenly increased like a trumpet. Alternatively, the tube 3A (the tube 3A has a larger passage cross section than that of other tubes 3B) described in the second embodiment can be used.

(Effects of the Third Embodiment)

In the intermediate plate 7D adjacent to the heat receiving plate 7A, the height (vertical length) of the opening portion 9*a* is limited within the length corresponding to the portion to which the heat-generating member 6 is attached, and therefore, the refrigerant vapor boiled by receiving the heat from the heat-generating member 6 is not diffused in a horizontal direction, and can be introduced upwardly along the opening portion 9*a* in an undiffused condition. As the large rectangular opening portion 8*a* is provided on the intermediate plate 7C adjacent to the heat radiating plate 7B in accordance with the size of the inserting hole 5*a* provided on the boiling area of the heat radiating plate 7B, the refrigerant vapor can easily pass through the opening portion 8*a*.

As the refrigerant vapor cannot be diffused in the refrigerant container 2, but can be collectively introduced into the tube 3A located within the boiling area of the heat radiating plate 7B, as well as the first embodiment, the refrigerant vapor diffused in the header tank 4 passes inevitably in the tubes 3B located out of the boiling area. Thereafter the refrigerant vapor can be cooled in the tubes 3B and circulated in the refrigerant container 2 as the condensate. Accordingly, the circulation of the refrigerant can be performed smoothly without interference of the refrigerant vapor and the condensate.

In the cooling apparatus 1 boiling and condensing refrigerant of the present embodiment, the refrigerant container 2 and the header tank 4 are constituted by superimposing a plurality of the plates 7 and the plates 10, respectively. Therefore, the contents of the refrigerant container 2 or the header tank 4 can be changed by increasing or decreasing the number of the plates 7 and the plates 10. Thus, the sizes (contents) of the refrigerant container 2 and the header tank 4 can be easily changed in accordance with increase or decrease the heat load or the like.

Furthermore, the identical plates can be used for the refrigerant container 2 and the header tank 4. In this case, the press die for manufacturing the plate can be identical and the expense of the press dies (die cost) can be reduced. Namely, the manufacturing cost for the cooling apparatus 1 boiling and condensing refrigerant can be reduced. As the identical plates can be used for the refrigerant container 2 and the header tank 4, the kind of the plates can be reduced and the management of the members can be easily performed.

(The Fourth Embodiment)

Figure 5:
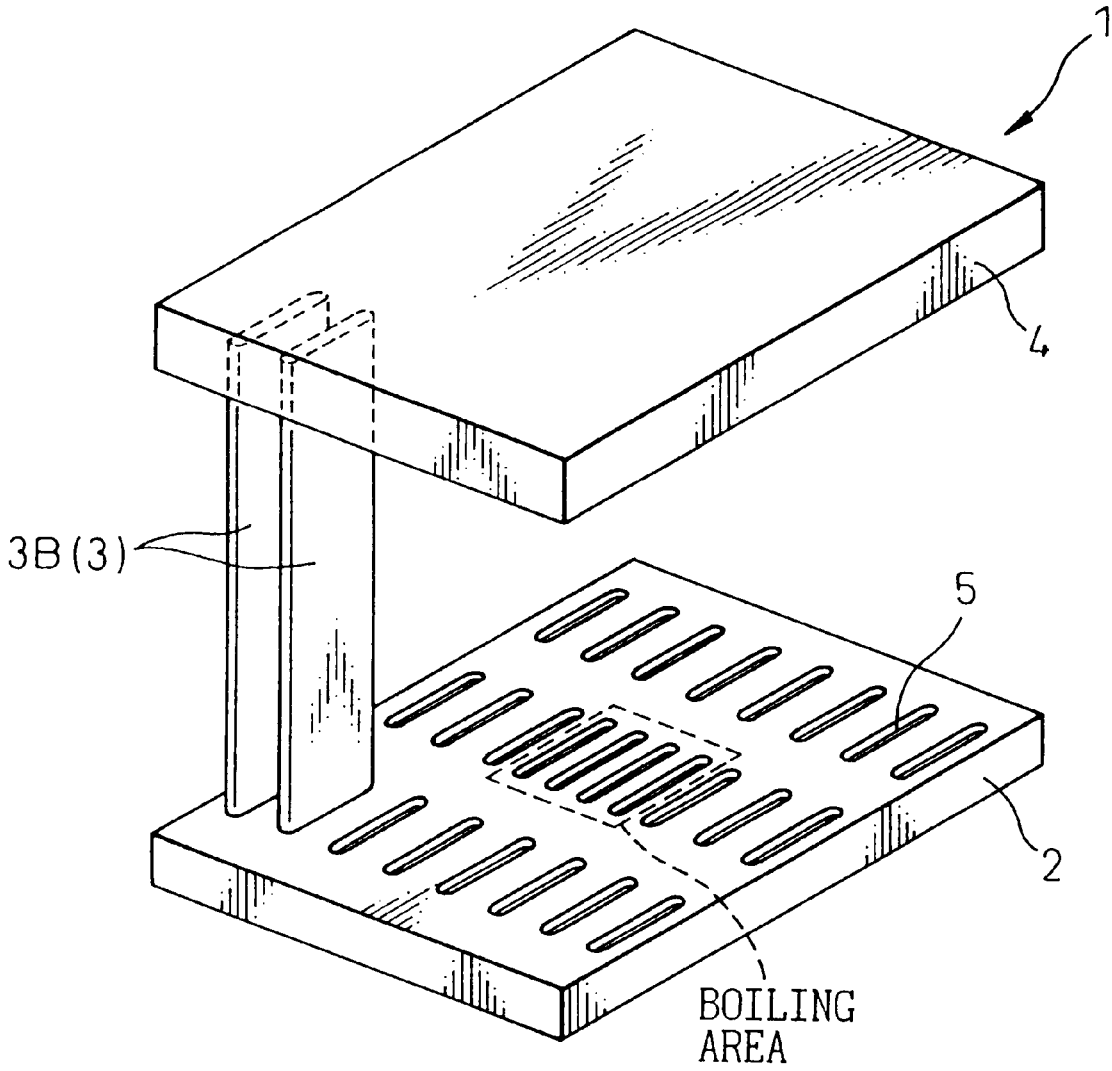
FIG. 5 is a perspective view of a cooling apparatus boiling and condensing refrigerant (the fourth embodiment).

FIG. 5 is a perspective view of a cooling apparatus 1 boiling and condensing refrigerant. This embodiment is a case wherein a plurality of tubes (the first tube group: not indicated in the drawing) are provided within a boiling area (an area indicated in dashed lines), by way of example. The distance between adjacent tubes of a plurality of the tubes located within the boiling area is smaller than that of adjacent tubes of a plurality of the tubes 3B (the second tube group) located out of the boiling area. The tube used for the first tube group and the tube 3B used for the second tube group have the identical shape and length.

According to the constitution of the embodiment, as the reduction of the distance between adjacent tubes of the first tube group enables to hold a larger passage cross section of the whole of the first tube group provided within the boiling area, most of the refrigerant vapor can be introduced in the header tank 4 through each tube 3A located within the boiling area. Thus, the refrigerant vapor diffused in the header tank 4 can be cooled by passing each tube 3B located out of the boiling area and can be circulated into the refrigerant container 2 as the condensate.

(The Fifth Embodiment)

Figure 6:
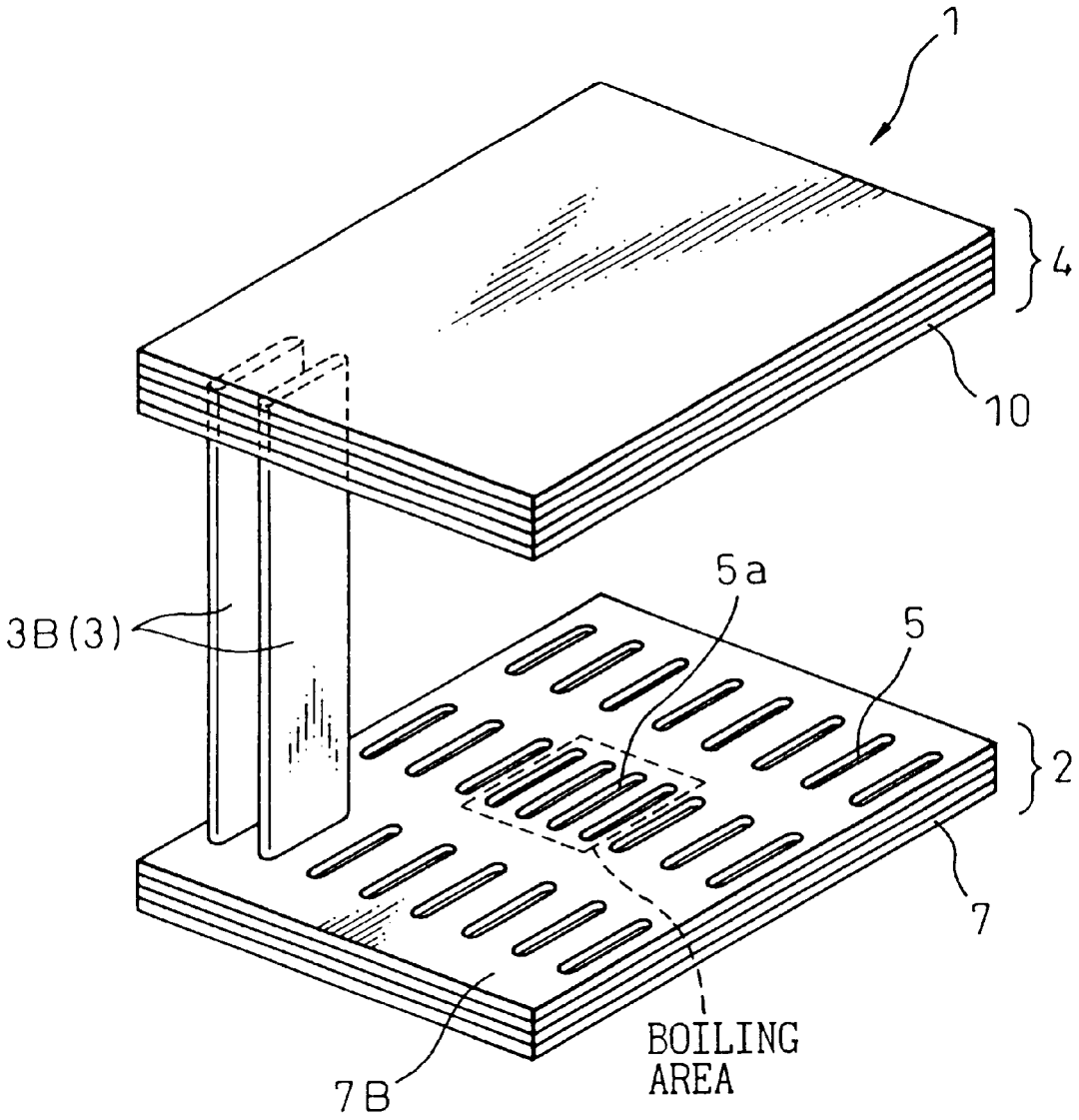
FIG. 6 is a perspective view of a cooling apparatus boiling and condensing refrigerant (the fifth embodiment).
Figure 7:
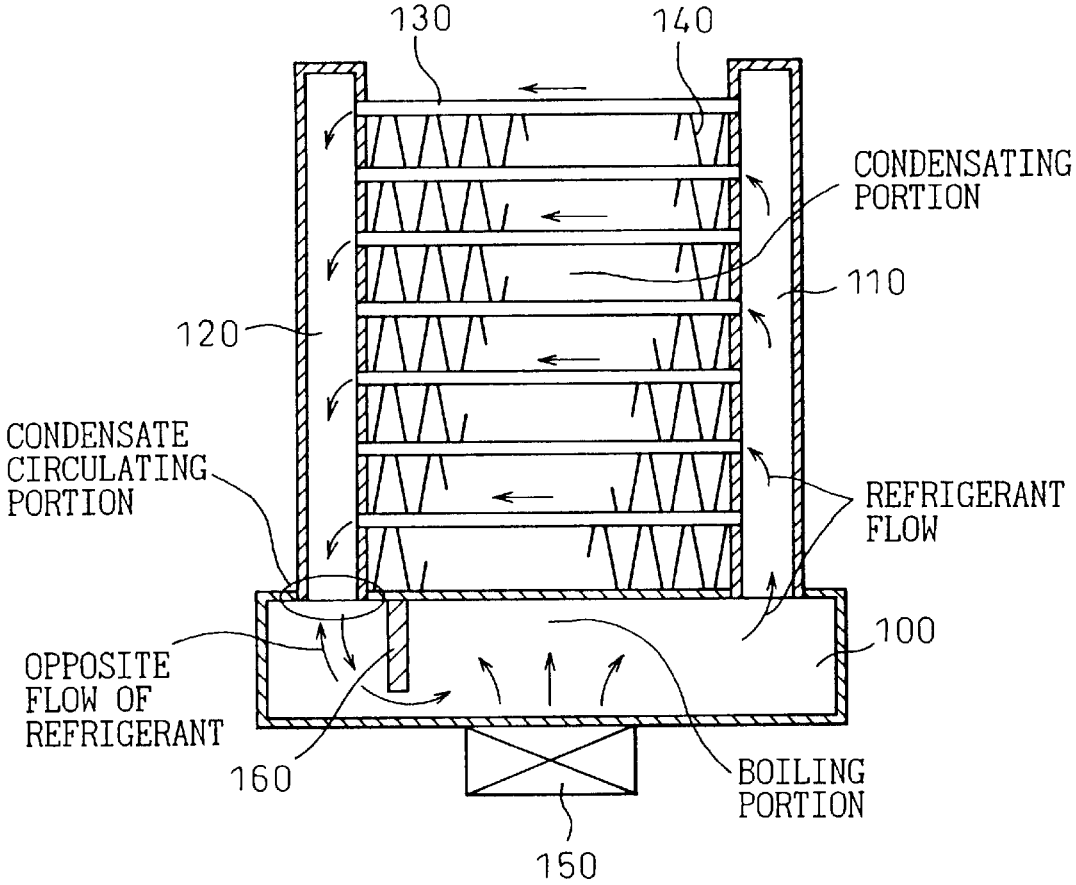
Fig.7 PRIOR ART
FIG. 7 is an elevational view of a cooling apparatus boiling and condensing refrigerant in prior art.

FIG. 6 is a perspective view of a cooling apparatus 1 boiling and condensing refrigerant. This embodiment is a case wherein the refrigerant container 2 and the header tank 4 described in the fifth embodiment are made in form of a multilayered structure, respectively, by way of example. The refrigerant container 2 and the header tank 4 are constituted by superimposing a plurality of the plates 7 and the plates 10, respectively, as well as the third embodiment. In the embodiment, a large rectangular opening portion, which corresponds to a plurality of the inserting holes 5*a* provided in the boiling area of the heat radiating plate 7B, is provided at a substantially center portion of the intermediate plate adjacent to the heat radiating plate 7B, so that the refrigerant vapor easily passes therethrough (refer to FIG. 4).

What is claimed is:

1. A cooling apparatus boiling and condensing refrigerant comprising;

a refrigerant container which has a heat-generating member attached to a bottom surface thereof and which reserves therein refrigerant which can be boiled by receiving heat from said heat-generating member, a heat radiating portion having a plurality of tubes, which are connected to the inside of the refrigerant container and are provided substantially upright on an upper surface of said refrigerant container, and a header tank by which the plural tubes are communicated;

wherein the refrigerant reserved in said refrigerant container can be boiled and evaporated by receiving heat from said heat-generating member and can be used to cool the heat-generating member by radiating latent heat of the refrigerant vapor from said heat radiating portion; and wherein assuming that a portion of the upper surface of the refrigerant container on which a mounting portion of the heat-generating member is projected is referred to as a boiling area, the plurality of tubes being comprised of a first tube group located within said boiling area and a second tube group located out of the boiling area, the adjacent tubes of the first tube group are spaced at a distance smaller than a distance between adjacent tubes of the second tube group.

2. A cooling apparatus boiling and condensing refrigerant, according to claim 1, wherein said refrigerant container is comprised of a plurality of intermediate plates having an opening portion extending through the thickness thereof, a heat receiving plate which is provided on its surface with the heat-generating member, and a heat radiating plate which is provided on its surface with the tubes;

wherein the refrigerant container is constituted by superimposing the plural intermediate plates between said heat receiving plate and said heat radiating plate; and wherein the opening portion of the intermediate plate adjacent to said heat radiating plate is made large corresponding to said boiling area projected on said heat radiating plate.

* * * * *